United States Patent [19]

Bron

[11] Patent Number: 4,493,458

[45] Date of Patent: Jan. 15, 1985

[54] ROTARY SPRINKLER

[76] Inventor: Dan Bron, 36 Palmach St., Haifa, Israel

[21] Appl. No.: 327,214

[22] Filed: Dec. 3, 1981

[30] Foreign Application Priority Data

Dec. 24, 1980 [IL] Israel ..... 61803

[51] Int. Cl.[3] ..... B05B 3/02; B05B 1/30

[52] U.S. Cl. ..... 239/230; 239/276; 239/533.1; 239/542

[58] Field of Search ..... 239/230, 237, 240, 241, 239/264, 276, 533.1, 570, 542, 571

[56] References Cited

U.S. PATENT DOCUMENTS

| | | | |
|---|---|---|---|
| 3,321,141 | 5/1967 | Gemeny | 239/276 X |
| 3,771,723 | 11/1973 | Ray | 239/230 X |
| 3,777,980 | 12/1973 | Allport | 239/542 X |
| 3,874,588 | 4/1975 | Flynn | 239/230 X |
| 4,011,893 | 3/1977 | Bentley | 239/542 X |
| 4,085,895 | 4/1978 | Curry et al. | 239/276 |
| 4,369,923 | 1/1983 | Bron | 239/533.1 X |
| 4,384,680 | 5/1983 | Mehoudar | 239/542 |

*Primary Examiner*—John J. Love

*Assistant Examiner*—Mary F. McCarthy

*Attorney, Agent, or Firm*—Murray Schaffer

[57] ABSTRACT

A two-part housing in which is mounted an elastically stretchable diaphragm dividing the interior of the housing into a substantially peripheral inlet chamber, and a central outlet chamber. The underside of the diaphragm is accessible to the pressure prevailing in the inlet chamber while at least one substantially tangentially oriented passageway connects the peripheral inlet chamber and the central outlet chamber. An inverted cup-like rotor having a hollow shaft is rotatably mounted in the housing, and a tubular projection substantially aligned with the hollow shaft extends inside the rotor. The rotor has an annular peripheral wall, the inner surface of which is provided with at least one discontinuity serving as a race for a ball. A flow of water introduced through the inlet connector enters the central outlet via the tangentially oriented passageways producing a vortex flow and exits the outlet chamber via the hollow shaft and the nozzle-like opening, simultaneously, imparting to the ball an orbital movement which, when encountering the transient discontinuity, imparts an impulse-like, limited angular motion to the rotor.

16 Claims, 11 Drawing Figures

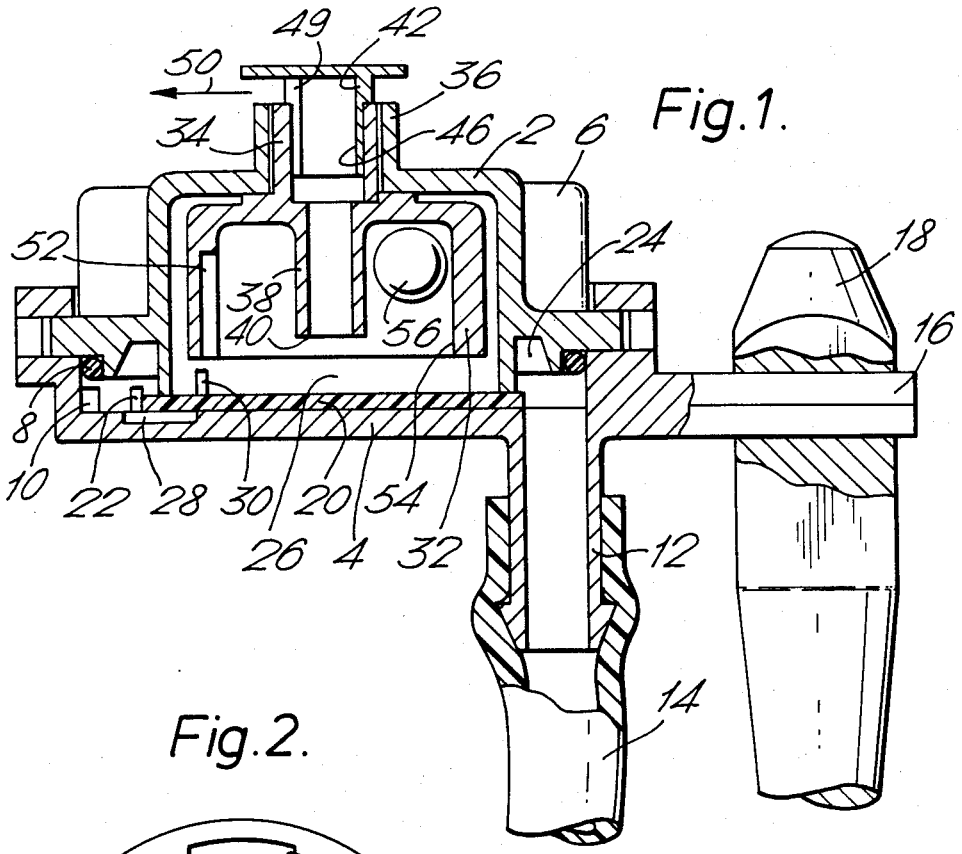
Fig.1.
Fig.2.
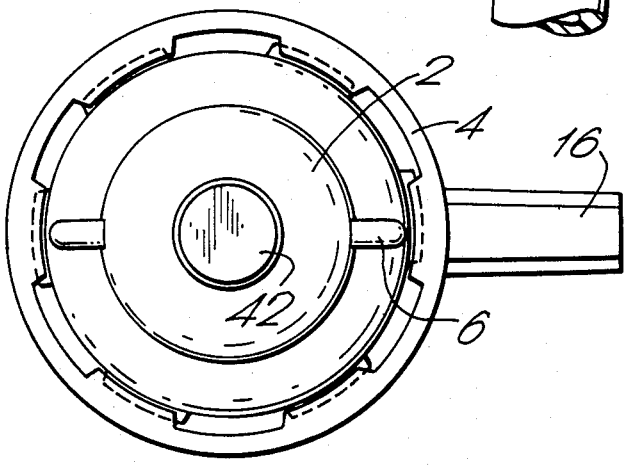
Fig.3.
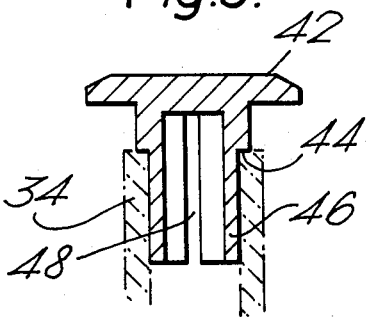

ROTARY SPRINKLER

The present invention relates to a pressure-regulated, rotating percussion sprinkler.

Percussion sprinklers, that is, sprinklers in which the reaction of an inertial mass on the sprinkler housing causes the latter, and thereby the jet, to rotate by discrete angular steps, are known and have been in use for years. These sprinklers are, however, large, have a throw of, sometimes, several meters and use large quantities of water. Also, they are not pressure-regulated and their throw is therefore affected by pressure variations in the line. If a number of such sprinklers are mounted in an array to irrigate a given area, an increase in pressure will cause the partial areas swept by the individual sprinklers to excessively overlap, thus overirrigating certain sections. With falling pressure, on the other hand, sprinkler sweep will drop and various spots will be underirrigated.

It is one of the objects of the present invention to overcome the disadvantages of the prior-art sprinklers and to provide a percussion sprinkler for medium throw and output, which will also be largely unaffected by pressure fluctuations in the supply line.

Thus the present invention achieves by providing a pressure-regulated, rotating percussion sprinkler, comprising a two-part housing, a pressure-regulating, elastically stretchable diaphragm dividing the interior of said two-part housing into a substantially peripheral inlet chamber provided with an inlet connector, the underside of which diaphragm is accessible to the pressure prevailing in said inlet chamber, and a central outlet chamber, at least one substantially tangentially oriented passageway connecting said peripheral inlet chamber and said central outlet chamber, an inverted-cup-like rotor comprising a hollow shaft rotatably mounted in a first part of said two-part housing and a tubular projection substantially aligned with said hollow shaft and extending inside said rotor, said cup-like rotor having a substantially annular peripheral wall, the inner surface of which is provided with at least one discontinuity constituted by a sudden and transient change of curvature and, in operation, serves as race for at least one spherical mass freely movable in the space delimited by said diaphragm and by the inside of said cup-like rotor, the bore of said hollow shaft terminating on the outside of said two-part housing in at least one relatively narrow, nozzle-like opening producing a sprinkling jet, a flow of water introduced through said inlet connector entering said central outlet chamber via said tangentially oriented passageways producing a vortex flow and exiting said outlet chamber via said hollow shaft and said nozzle-like opening, wherein said vortex flow entrains said spherical mass, imparting to it an orbital movement upon and along said race, whereby, upon encountering, and prior to being carried by its angular momentum over, said transient discontinuity, said spherical mass imparts an impulse-like, limited angular motion to said rotor and, thereby, to said sprinkling jet.

While the invention will now be described in connection with certain preferred embodiments with reference to the following illustrative figures so that it may be more fully understood, it is stressed that the particulars shown and described are by way of example and for purposes of illustrative discussion only and are presented in the cause of providing what is believed to be the most useful and readily understood description of the principles and conceptual aspects of the invention. In this regard no attempt is made to show structural details of the devices and their elements in more detail than is necessary for a fundamental understanding of the invention, the description taken with the drawings making apparent to those skilled in the art how the several forms of the invention may be embodied in practice.

In the drawings:

FIG. 1 shows a cross-sectional view of a preferred embodiment of the percussion sprinkler according to the invention;

FIG. 2 is a plan view of the embodiment of FIG. 1, without the mounting stake;

FIG. 3 is a cross-sectional view, enlarged and rotated by 90°, of the cap shown in FIG. 1;

Figure 4:
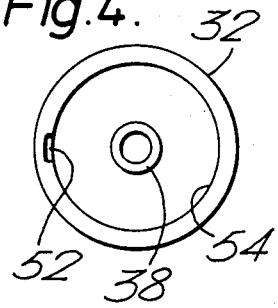
FIG. 4 shows a bottom view of the rotor of the embodiment of FIG. 1.

There is seen in FIGS. 1 and 2 a two-part housing comprising a first or upper part or member 2 and a second or lower part or member 4 which, in this preferred embodiment of the invention, are detachably joined by means of an as such known multi-tab wedge-type bayonet joint. A slight counterclockwise rotation of the upper member 2, relative to the lower member 4, facilitated by two gripping ribs 6, will bring each member's tabs into alignment with the other member's slots, thereby unlocking the bayonet joint. Watertightness of the joint is ensured by an O-ring 8 prevented from dropping to the bottom of the lower member 4 by a number of projections 10 arranged along the inside periphery of the lower member 4. The lower member 4 is also provided with an inlet connector 12 connectable via a rubber or plastic tube 14 to the water supply. Part of the lower member 4 is also a projection 16 which serves for mounting the sprinkler with the aid of a stake 18 which has near its upper end an opening fitting the projection 16 and the lower end of which is adapted to be driven into the soil (see also FIG. 6). As clearly seen in FIG. 2, the projection 16 slightly tapers towards its free end. Once pushed into the appropriately shaped opening of the mounting stake 18, the projection will stick to it by wedge effect.

A pressure-regulating, elastically stretchable diaphragm 20, centered and secured against lateral displacement by a number of short posts 22 integral with the lower housing member 4, divides the interior of the two-part housing into a peripheral inlet chamber 24 and a central outlet chamber 26. Below the diaphragm 20, a short channel or groove 28 permits the inlet pressure prevailing in the inlet chamber 24 to act on the diaphragm 20, or to be more precise, on the underside thereof, while its upper surface is exposed to the pressure in the outlet chamber 26. However, as the water, exiting this chamber on its way to the outside encounters relatively little resistance, a pressure drop is produced in chamber 26, detected by the diaphragm as a pressure differential which will cause the elastic diaphragm to bulge upwards, and its central zone will approach the narrow-lipped end 40 of the tubular projection 38, restricting outflow therethrough. A restricted outflow, in its turn, will increase water pressure in the outlet chamber 26, thereby reducing the pressure differential between the inlet chambers 24 and the outlet chamber 26, thus permitting the elastic force of the diaphragm 20 to reduce the bulge to some degree, thereby again increasing outflow. An equilbrium is eventually established, which constitutes the working point of this regulating device, which depends only on the elastic properties of the diaphragm 20.

Above the diaphragm 20, the inlet chamber 24 and the outlet chamber 26 are connected by a tangentially oriented passageway 30, the function of which will be explained further below. Inside the outlet chamber 26, there is located an inverted-cup-like rotor 32 having a hollow shaft 34 rotatably mounted in a collar 36 integral with the upper housing member 2. A tubular projection 38, coaxial with the hollow shaft 34 and having a narrow-lipped end 40, is part of the pressure-regulating mechanism.

The hollow shaft 34 is closed towards the outside by a cap 42, shown as rotated by 90° and to an enlarged scale in FIG. 3. With a shoulder 44, the cap 42, having a hollow shank 46, is seated against the end of the hollow shaft 34. At one point, the hollow shank 46 is provided with a longitudinal slot 48 extending beyond the shoulder 44 and thus provides a relatively narrow, nozzle-like opening 49 (FIG. 1), through which water can escape in direction of arrow 50 in FIG. 1.

The cup-like rotor 32 has a substantially annular wall, the inner surface of which is provided with a discontinuity in the form of a shallow groove 5, seen in a bottom view in FIG. 4. This inner surface serves as a race 54 to a stainless-steel ball 56 freely movable in the space delimited by the diaphragm 20 on the one hand, and by the inside of the rotor 32, on the other.

In operation, the rotary sprinkler according to the invention functions as follows:

Water introduced via the inlet connector 12 and entering the central outlet chamber 26 via the tangentially oriented passageway 30, produces a vortex flow, before leaving the sprinkler via the tubular projection 38, the hollow shank 46 and the nozzle-like opening 49. This vortex flow entrains the steel ball 56, imparting to it an orbital movement upon and along the race 54, against which the ball 56 is pressed by centrifugal force. The rotor 32, on the other hand, is hardly affected by the vortex flow as such, as whatever resistance it may offer to the flow is offset by the considerable friction opposing rotation, which friction is enhanced by the tilting moment introduced due to the one-sided mounting of the rotor 32. When, in its orbital movement, the steel ball 56 now encounters, and drops into, the groove-like discontinuity 52, it will impart to the rotor 32 an impulse-like, limited angular motion, before its angular momentum carries it over the edge of the groove 52, to continue its orbital movement. The arrangement thus functions in the manner of a large-ratio reduction gear, the rotor 32—and thereby the jet issuing from the nozzle-like opening 49—moving by a few degrees only for each full circle of the ball 56.

Figure 5:
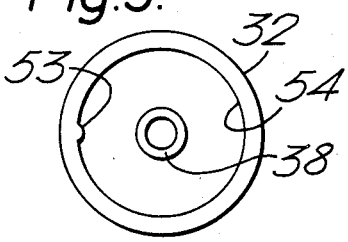
FIG. 5 is a bottom view of another embodiment of this rotor.

While in the preferred embodiment the discontinuity 52, as already explained, is in the form of a groove, a similar effect would be obtained if the discontinuity were in the form of a ridge 53, as shown in FIG. 5.

The percussion sprinkler according to the invention is advantageously made of one or several of the commonly used industrial plastics, such as acetal for the upper and lower housing members 2 and 4, acetal+Si for the rotor 32 and polypropylene for the cap 42.

Figure 6:
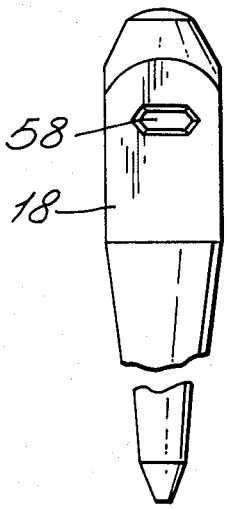
FIG. 6 is a partial view of a mounting stake used with the sprinkler of FIG. 1.

FIG. 6 is a partial view of the mounting stake 18 of FIG. 1, shown rotated by 90°. The hole 58 is slightly tapered, at an angle similar to that of the projection 16 (FIGS. 1 and 2), and will maintain a tight grip on the projection 16, once the latter has been introduced into it.

Figure 8:
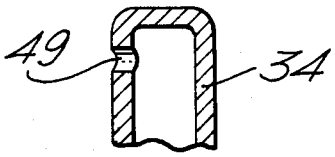
FIG. 8 is a detail, in cross section, showing another embodiment of the nozzle-like opening.
Figure 7:
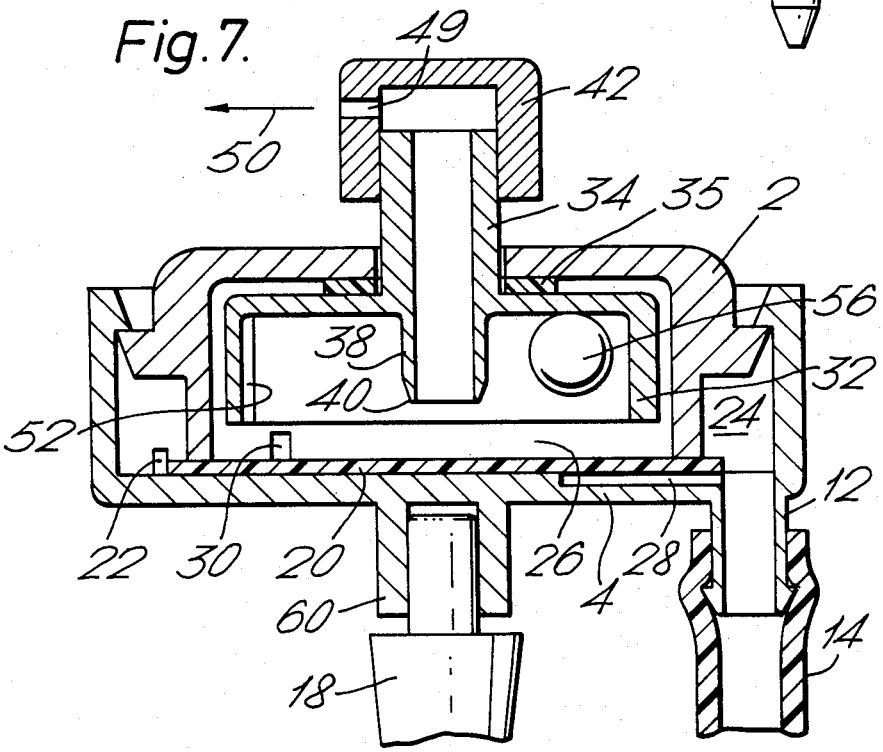
FIG. 7 is a cross-sectional view of another embodiment of the sprinkler according to the invention.

Another embodiment of the percussion sprinkler according to the invention is shown in FIG. 7. The main difference between the embodiment of FIG. 1 and that of FIG. 7 is the connection between the housing members, which, in the embodiment of FIG. 7 is a snap joint, as opposed to the bayonet joint of FIG. 1. Another difference is in the shape and location of the mounting projection 60 which, in the embodiment of FIG. 7 is located below the lower housing member 4. Also, a sealing and antifriction washer 35 is provided, seated on the hollow shaft 34 and separating the rotor from the inside face of the upper housing member 2. The cap 42, incorporating the nozzle-like opening 49, is in this embodiment pushed over, rather than introduced into, the hollow shaft 34. In yet another embodiment, the nozzle-like opening 49 is made an integral part of the hollow shaft 34 (FIG. 8). All other components are functionally analogous and carry the same numbers.

In this embodiment, too, the discontinuity 52, shown in FIG. 7 as a groove, may be in the form of a ridge.

Figure 9:
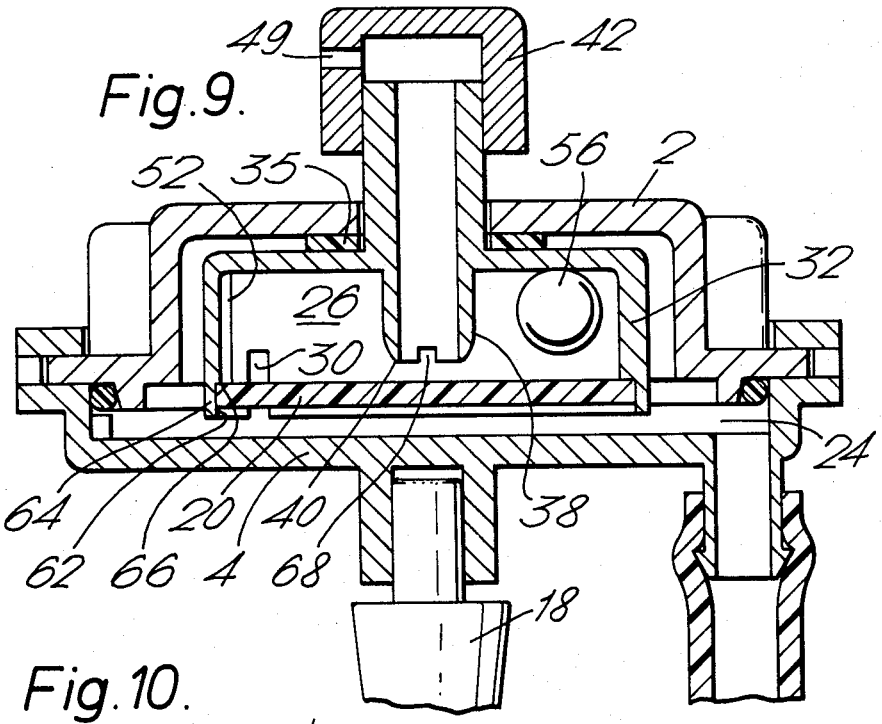
FIG. 9 is a cross-sectional view of yet another embodiment of the sprinkler according to the invention.

Yet another embodiment is shown in FIG. 9. While the two-part housing with its bayonet-type joint resembles that of the embodiment of FIG. 1 (except for the central mounting of the stake 18), the novel aspect of this embodiment is the relationship between the rotor 32 and the diaphragm 20. Whereas in the embodiment of both FIG. 1 and FIG. 7, the diaphragm 20 rests on the bottom of the lower housing member 4 and is retained in this position by the lower rim of the upper housing member 2 which, normally, also prevents the diaphragm 20 from making contact with the rotor 32, in the embodiment of FIG. 9 the diaphragm 20 is seated in a recess 62 in the lower rotor rim 64, ending in a shoulder 66. The tangentially oriented passageway 30 which, in the previous embodiments, is provided in the lower rim of the upper housing member 2, is now cut in the annular wall of the inverted-cup-shaped rotor 32 itself. The rotor 32, diaphragm 20 and passageway 30 now constitute an independent, selfcontaining unit, rotating together step by step, whenever impulsed by the orbiting steel ball 56. As the underside of the diaphragm 20 is in this embodiment always accessible to the pressure in the inlet chamber 24, the short channel 28 of the previous embodiment can be dispensed with.

Another feature of the present embodiment is a narrow and shallow slot 68 cut across the lip 40 of the tubular projection 38. This slot 68 was seen to have the effect of improving the flatness of the output-vs.-pressure curve also in the highest-pressure region.

Figure 10:
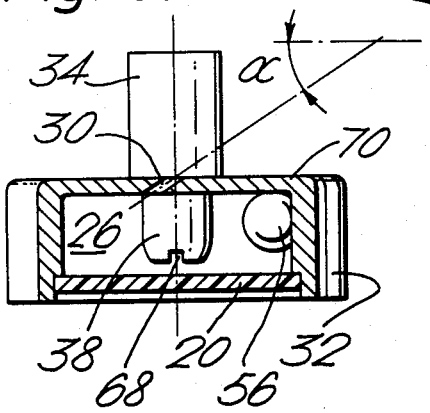
FIG. 10 is a view, in cross section along plane X—X of FIG. 11, of the rotor of a variant of the embodiment of FIG. 9.
Figure 11:
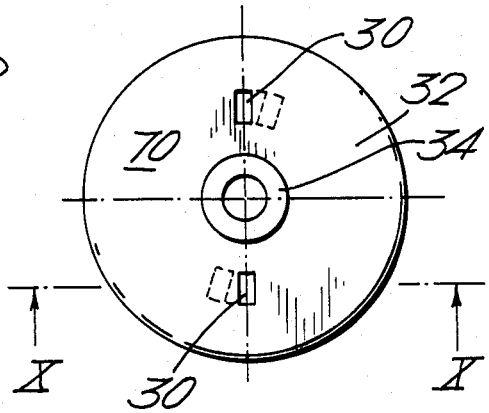
FIG. 11 is a top view of the rotor shown in FIG. 10.

In a variant of the embodiment of FIG. 9, the rotor of which is shown in FIGS. 10 and 11, the passageways 30 are provided on the bottom surface 70 of the inverted-cup-like rotor 32, rather than close to the diaphragm 20 in the lower portion of the annular rotor wall. Due to the relatively small angle of slope $\alpha$, the water entering the outlet chamber 26 through these passageways 30 is imparted a large tangential component which produces the vortex flow driving the steel ball 56 around.

The sealing washer 35 (FIG. 9) can of course also be integral with the rotor 32, as in FIG. 1, and the passageways 30 can be provided at points other than those indicated in FIGS. 9–11.

While particular embodiments of the invention have been described, it will be evident to those skilled in the art that the present invention may be embodied in other specific forms without departing from the essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

What is claimed is:

1. A pressure-regulated, rotating percussion sprinkler, comprising a two-part stationary housing, and an elastically stretchable diaphragm, the parts of said housing and said diaphragm being arranged so that said diaphragm divides the interior of said housing into a substantially peripheral inlet chamber and a central outlet chamber located above said diaphragm, said inlet chamber being provided with an inlet connector, the underside of said diaphram being accessible to the pressure prevailing in said inlet chamber, at least one substantially tangentially oriented passageway connecting said peripheral inlet chamber and said central outlet chamber, an inverted-cup-like rotor comprising a hollow shaft rotatably mounted in a first part of said two-part housing, and a tubular projection substantially aligned with said hollow shaft and extending inside said rotor, said cup-like rotor having a substantially annular peripheral wall, the inner surface of which is provided with at least one discontinuity constituted by a sudden and transient change of curvature and, in operation, serves as race for at least one spherical mass freely movable in the space delimited by said diaphragm and by the inside of said cup-like rotor, the bore of said hollow shaft terminating on the outside of said housing in at least one relatively narrow, nozzle-like opening producing a sprinkling jet, a flow of water introduced through said inlet connector entering said central outlet chamber via said tangentially oriented passageways producing a vortex flow and exiting said outlet chamber via said hollow shaft and said nozzle-like opening, said flow of water through said outlet chamber creating a pressure differential in said chamber relative to the pressure prevailing on the underside of said diaphragm to cause said diaphragm to bulge restricting the flow of water through said outlet chamber and seeking to equalize the pressure therein with that of said inlet pressure, wherein said vortex flow entrains said spherical mass, imparting to it an orbital movement upon and along said race, whereby, upon encountering, and prior to being carried by its angular momentum over said transient discontinuity, said spherical mass imparts an impulse-like, limited angular motion to said rotor and, thereby, to said sprinkling jet.

2. The percussion sprinkler as claimed in claim 1, wherein said spherical mass is a stainless steel ball.

3. The percussion sprinkler as claimed in claim 1, wherein said nozzle-like opening is provided in a cap tightly fitting the outside end of said hollow shaft.

4. The percussion sprinkler as claimed in claim 1, wherein said nozzle-like opening is integral with said hollow shaft.

5. The percussion sprinkler as claimed in claim 1, wherein a sealing and anti-friction washer is provided seated on said hollow shaft and separating said rotor from the inside face of said first housing part.

6. The percussion sprinkler as claimed in claim 1, wherein said discontinuity is constituted by a groove-like recess extending across said race.

7. The percussion sprinkler as claimed in claim 1, wherein said discontinuity is constituted by a ridge-like projection extending across said race.

8. The percussion sprinkler as claimed in claim 1, wherein a second part of said two-part housing is provided with a projection, facilitating the attachment of said sprinkler to a mounting stake.

9. The percussion sprinkler as claimed in claim 1, wherein the connection between the two parts of said two-part housing is a bayonet-type joint.

10. The percussion sprinkler as claimed in claim 1, wherein the connection between the two parts of said two-part housing is a snap joint.

11. The percussion sprinkler as claimed in claim 1, wherein said rotor rotates relative to said diaphragm and said passageway.

12. The percussion sprinkler as claimed in claim 1, wherein said rotor is stationary relative to said diaphragm and said passageway.

13. The percussion sprinkler as claimed in claim 12, wherein said passageway is provided in the peripheral wall of said inverted-cup-like rotor.

14. The percussion sprinkler as claimed in claim 12, wherein said passageway is provided in the bottom surface of said inverted-cup-like rotor.

15. The percussion sprinkler as claimed in claim 1, wherein a relatively narrow and shallow slot is provided across the extremity, facing said diaphragm, of said tubular projection, which slot cooperates with said diaphragm to improve and enhance said pressure-regulating effect.

16. The sprinkler according to claim 1 wherein said diaphragm is fixedly held between said housing parts.

* * * * *